United States Patent [19]

Bodewein

[11] Patent Number: 4,983,096

[45] Date of Patent: Jan. 8, 1991

[54] DEVICE FOR STACKING SHEETS, ESPECIALLY SHEETS OF CARDBOARD

[75] Inventor: Jakob Bodewein, Düsseldorf, Fed. Rep. of Germany

[73] Assignee: Jagenberg Aktiengesellschaft, Dusselforf, Fed. Rep. of Germany

[21] Appl. No.: 377,515

[22] Filed: Jul. 10, 1989

[30] Foreign Application Priority Data

Jul. 14, 1988 [DE] Fed. Rep. of Germany ..... 3823806

[51] Int. Cl.[5] ..... B65G 31/32

[52] U.S. Cl. ..... 414/789.5; 414/790.8; 270/95; 271/218

[58] Field of Search ..... 414/789.5, 790.8, 794.4, 414/924, 926, 927; 270/95; 271/215, 217, 218

[56] References Cited

U.S. PATENT DOCUMENTS

| | | | |
|---|---|---|---|
| Re. 23,641 | 4/1953 | Andren | 414/789.5 X |
| 4,469,321 | 9/1984 | Geschwinder | 271/218 X |
| 4,662,816 | 5/1987 | Fabrig | 414/790.8 X |
| 4,799,847 | 1/1989 | Bodewein | 414/790.8 |

FOREIGN PATENT DOCUMENTS

| | | | |
|---|---|---|---|
| 1436511 | 12/1969 | Fed. Rep. of Germany . | |
| 3535113 | 4/1987 | Fed. Rep. of Germany . | |
| 3539099 | 5/1987 | Fed. Rep. of Germany . | |
| 1319931 | 1/1963 | France | 271/218 |
| 119655 | 9/1980 | Japan | 271/218 |

OTHER PUBLICATIONS

Photoelectronik für die Druckerei-Industrie, 1972.

*Primary Examiner*—Robert J. Spar
*Assistant Examiner*—Craig Slavin
*Attorney, Agent, or Firm*—Sprung Horn Kramer & Woods

[57] ABSTRACT

A device for stacking sheets, especially sheets of cardboard, comprising a mechanism that continuously supplies the sheets to a stacking platform that can be lowered, an auxiliary stacking platform that can be advanced into the stacking area, and a ream-demarcating mechanism for inserting ream-demarcation strips between the rear edges of the sheets while they are being laid off. The auxiliary stacking platform (13) cannot move up and down. The outlet end (18) of the ream-demarcating mechanism (15) can be moved vertically between the sheet-supply mechanism (3) and the auxiliary stacking platform.

3 Claims, 1 Drawing Sheet

DEVICE FOR STACKING SHEETS, ESPECIALLY SHEETS OF CARDBOARD

The invention concerns a device for stacking sheets, especially sheets of cardboard.

Stackers have known mechanisms that insert strips of paper into the stack once a specific number of sheets has been laid off to demarcate the different reams.

To allow continuous stack replacement, some known stackers have an auxiliary stacking platform that can be introduced horizontally into the stack and that a provisional stack can be constructed on while the finished stack on the main stacking platform is removed.

A general device is described in my U.S. Pat. No. 4,799,847. It has a bar grating that can be inserted between the laid-off and the conveyed sheets to accommodate the provisional stack. It is stated that an injector for inserting ream-demarcating strips can be accommodated in a space that is not occupied by a rod.

The stacker described in my U.S. Pat. No. 4,799,847 is complicated and is intended for laying off sheets of thin material, paper for example. The auxiliary stacking platform can be lifted up to the feed level to ensure the short drop that is necessary when laying off thin and sensitive paper.

The level of the auxiliary stacking platforms employed in devices for laying off thicker sheets, of cardboard for example, are known to be fixed, meaning that the platform does not travel up and down. Since cardboard is more stable and can be dropped from higher up and since its greater weight dictates that the outlet-end deflection pulleys of the belt that supplies the sheets be larger, the rod-grating auxiliary stacking platforms in these stackers are approximately 250 mm below the feed level. When the outlet end of the ream-demarcating mechanism is directly below the feed level, the first sheets in a stack that are laid off on the rod grating may not get demarcated.

The object of the invention is accordingly to provide a device for stacking sheets that ensures that the whole stack will be supplied with ream-demarcation strips even when the drop onto an auxiliary stacking platform that does not move up and down is longer than the height of the ream being demarcated.

This object is attained by making the outlet end of the ream-demarcating mechanism vertically movable between the sheet supply mechanism and the auxiliary stacking platform.

A component that continuously detects the height of the stack rising on the auxiliary stacking platform, and controls that adjust the level of the outlet end of the ream-demarcating mechanism to the level of the top of the stack allow the outlet end of the ream-demarcating mechanism to automatically adjust to the particular vertical position of the gap between the top sheet of the stack and the arriving sheet, between which the ream-demarcation strip is to be inserted.

A ream-demarcating mechanism for use with an auxiliary stacking platform in the form of a rod grating that occupies very little of the very tight space in the ejection section between the auxiliary stacking platform and the feed level makes it possible to accommodate the other components, the ream-demarcation strip magazine for example, in the more accessible area below the auxiliary stacking platform.

One or more ream-demarcating mechanisms can be set for different format widths. Several ream-demarcating mechanism are necessary when a web that is being cut transversely is simultaneously being slit longitudinally into several individual webs, so that several adjacent stacks must be constructed simultaneously.

The motion of a mechanism that dictates the height of the stack can advantageously be synchronized with the motion of the ream-demarcating mechanism.

One embodiment of the invention will now be described with reference to the schematic drawings.

Figure 2:
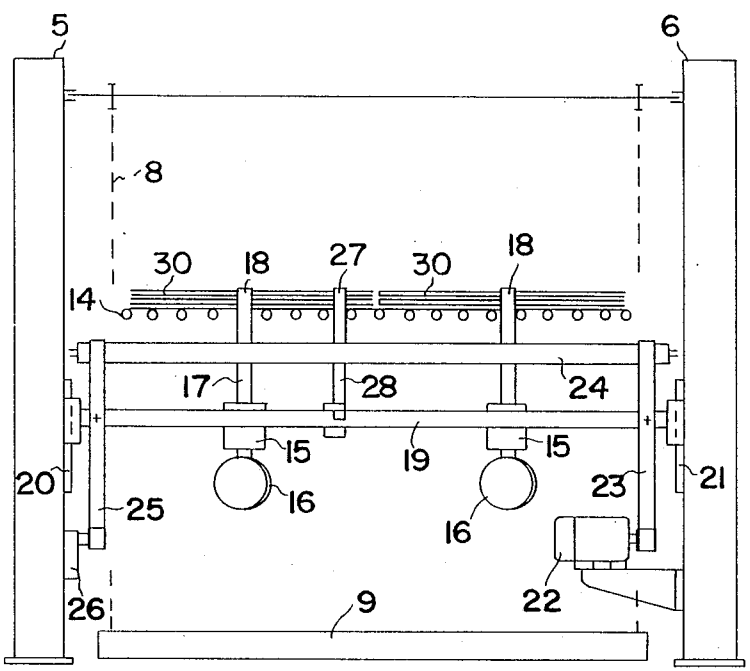
FIG. 2 is a view along the direction in which the sheets travel.

The embodiment that will now be described is employed to lay off sheets 1 of cardboard that arrive continuously and overlapped onto a stack 2 downstream of a sheeter. Outlet-end pulleys 3.1 of a conveyor belt 3 that supplies the sheets are mounted along with ejection rollers 4 above the maximum stack height in two lateral uprights 5 and 6 in the layboy frame. In stacking area 7 there is a main stacking platform 9 that is suspended on cords 8, that moves up and down, and on which there rests a pallet 10 for accommodating the rising stack 2. The front edges of the sheets are aligned while they are being laid off by a stop board 11 that does not move up and down but can be adjusted horizontally to various format lengths.

Directly below the bottom strand of belt 3 and approximately 250 mm below the feed level, an auxiliary stacking platform 13 that can be advanced horizontally into stacking area 7 is mounted in uprights 5 and 6 and in lateral crossarms 12. Platform 13 is made of parallel rods 14. Auxiliary stacking platforms of this type are called rod gratings.

Suspended from uprights 5 and 6 and directly upstream of stacking area 7 are ream-demarcating mechanisms 15, two in the present case, that insert ream-demarcation strips into the stack and that will now be described in greater detail.

Each ream-demarcating mechanism 15 has a reel holder 16, integrated advance roller, and an orientation channel 17. At the outlet end 18 of orientation channel 17 is a trimmer that cuts off the section of ream-demarcation strip extending out of the channel. Ream-demarcating mechanisms 15 are secured to and move back and forth on a shaft 19 that extends along the operating width of the stacker. Shaft 19 moves up and down in lateral guides 20 and 21 on uprights 5 and 6. The vertical motion of ream-demarcating mechanisms 15 is governed by a motor 22 mounted on upright 6 and driving a toothed belt 23 that is tensioned by a shaft 24 secured at each end in uprights 5 and 6. Since shaft 19 is secured to one strand of toothed belt 23, it can be raised and lowered by motor 22. To ensure that it remains level while moving up and down, the other end of shaft 19 is secured to one strand of a synchronizing strap 25. Synchronizing strap 25 extends both around shaft 24 and around a tensioning roller 26 secured to upright 5.

Ream-demarcating mechanisms 15 move up and down such that the outlet end 18 of orientation channel 17 can be raised to directly below lower ejection roller 4 and lowered to below the rods 14 in auxiliary stacking platform 13. While moving up, orientation channel 17 travels between the individual rods 14. When in the lowered position, it is possible to transversely adjust the ream-demarcating mechanisms 15 to various format widths.

Outlet end 18 is adjusted to the changing height of the stack with a sensor 27, an optical sensor in the present case, that detects the height and that is also secured in a mount 28 on shaft 19. The insertion of a ream-demarcation strip (by advancing the strip along orientation channel 17 and trimming off the projecting section) is controlled by unillustrated controls in accordance with the number of laid-off sheets 1 counted by a sheet counter.

Figure 3:
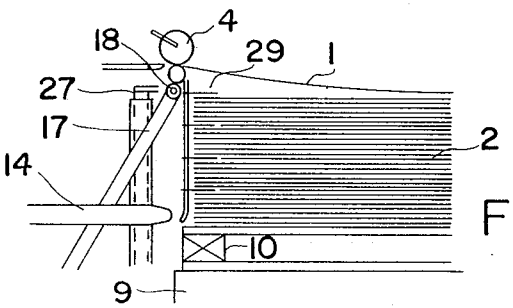
FIG. 3 is a larger-scale detail of FIG. 1 while sheets are be laid off onto a pallet.
Figure 1:
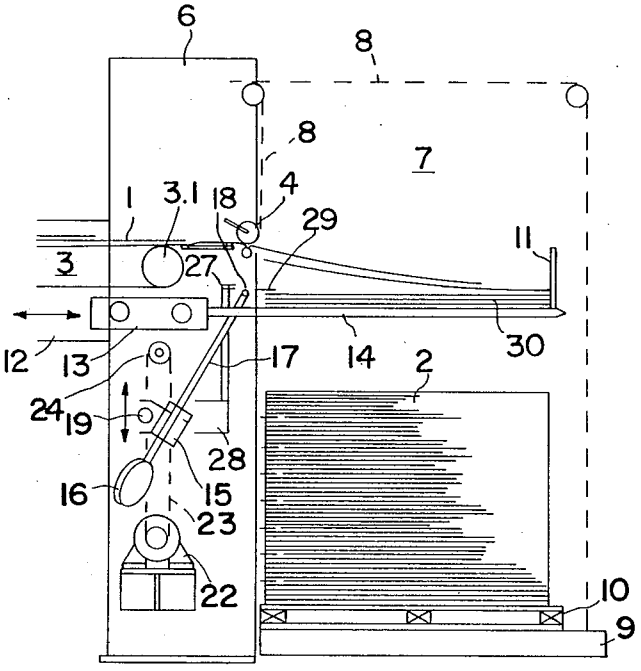
FIG. 1 is a side view of a stacker in accordance with the invention while sheets are being laid off onto an auxiliary stacking platform.

How the stacker operates will now be described. Rods 14 are outside stacking area 7 while sheets 1 are being stacked on pallet 10 (FIG. 3). The outlet end 18 of the orientation channel 17 in ream-demarcating mechanisms 15 is raised to just below ejection rollers 4 so that ream-demarcation strips 29 can be inserted into the gap between the rear edge of the arriving sheet 1 and the top of the stack. One strip is inserted whenever a prescribed number (e.g. 125) of sheets has been laid off and is trimmed after a slight delay to allow the inserted strips 29 to be secured by the subsequently arriving sheets. To ensure that the height of stack 2 and hence the distance that sheets 1 drop through remains constant, main stacking platform 9 is continuously lowered. The lowering is controlled by unillustrated controls by way of sensor 27.

Once stack 2 has attained the prescribed height, a few sheets 1 are deflected out to generate a slight gap in the overlapping flow and, during the resulting interruption in the layoff process, rods 14 enter stacking area 7 and intercept the subsequent sheets 1 to allow the finished stack 2 to be removed. Motor 22 simultaneously lowers shaft 19 along with the ream-demarcating mechanisms 15 and sensor 27 mounted on it to the top of stack 30, which is laid off onto rods 14. Motor 22 is then instructed by sensor 27 to raise the outlet end 18 of the ream-demarcating mechanism in synchronization with the top of stack 30. Once a fresh pallet 10 has been advanced into stacking area 7 and lifted by main stacking platform 9 to just below it, rods 14 are withdrawn from the area. Finished stack 30 is simultaneously laid off onto pallet 10. Once the top of the stack 2 on pallet 10 is just below ejection rollers 4, the controls lower main stacking platform 9 to maintain the height of the stack constant. The outlet ends 18 of ream-demarcating mechanisms 15 along with sensor 27 remain at the same level (FIG. 3) until the stack is replaced.

It will be understood that the specification and examples are illustrative but not limitative of the present invention and that other embodiments within the spirit and scope of the invention will suggest themselves to those skilled in the art.

What is claimed is:

1. In a device for stacking sheets, such as cardboard, comprising a mechanism that continuously supplies the sheets to a stacking area located above a stacking platform that can be lowered, an auxiliary stacking platform that can be advanced into the stacking area, and a ream-demarcating mechanism for inserting ream-demarcation strips between the rear edges of the sheets while they are being laid off, the improvement wherein the auxiliary stacking platform (13) cannot move up and down, and the outlet end (18) of the ream-demarcating mechanism (15) is located forwardly of the sheet supply mechanism and rearwardly of the stacking area and can be moved vertically between the sheet-supply mechanism (3) and the auxiliary stacking platform, the auxiliary stacking platform (13) being in the form of a rod grating, the ream-demarcating mechanism (15) being provided with an orientation channel (17) that extends up between rods (14) in the auxiliary stacking platform, the ream-demarcating mechanism (15) being secured to a shaft (19) that extends transversely below rods (14) in the auxiliary stacking platform (13), means being provided for lowering the outlet end (18) of the ream-demarcating mechanism below the rods, the device further including a component (27) that continuously detects the height of the stack (30) rising on the auxiliary stacking platform (13), and controls that adjust the level of the outlet end (18) of the ream-demarcating mechanisms (15) as the level of the top of the stack rises.

2. A device as in claim 1, wherein the component (27) that detects the height of the stack (30 or 2) is secured to a shaft (19) that can be moved up and down.

3. A device as in claim 1, including means for transversely adjusting the ream-demarcating mechanism to various format widths.

* * * * *